United States Patent [19]

Wu

[11] Patent Number: 4,792,311

[45] Date of Patent: Dec. 20, 1988

[54] ELECTRICAL PLUG AND SOCKET HAVING REPLACEABLE OVERCURRENT PROTECTION DEVICE WITH SAFETY LATCH MEANS

[76] Inventor: Jeng-Shyong Wu, No. 133, Tungshing Rd., Toufun, Maulii, Taiwan

[21] Appl. No.: 942,505

[22] Filed: Dec. 16, 1986

Related U.S. Application Data

[62] Division of Ser. No. 693,015, Jan. 18, 1985, abandoned.

[51] Int. Cl.[4] ..... H01R 13/68

[52] U.S. Cl. ..... 439/622; 337/197

[58] Field of Search ..... 337/197, 198, 201, 213; 439/621, 622, 597-601, 650-652, 695-698

[56] References Cited

U.S. PATENT DOCUMENTS

| | | | |
|---|---|---|---|
| 2,640,184 | 5/1953 | Bauer | 337/198 |
| 3,031,637 | 4/1962 | Descarries | 439/457 |
| 4,420,214 | 12/1983 | Wu | 439/622 |
| 4,480,891 | 11/1984 | Wu | 439/622 |

*Primary Examiner*—Gil Weidenfeld
*Assistant Examiner*—Gary F. Paumen
*Attorney, Agent, or Firm*—McGlew and Tuttle

[57] ABSTRACT

An electrical plug and socket with a replaceable over-current protection device. The over-current protection device is made retractable by a removable securing body that attaches to the overcurrent protection device. The securing body is comprised of two members which sit on top of one another and hold secure the connection of the over-current protection device to its contacts. The securing body keeps the overcurrent protection device ane its connections in place by means such as a spring that engages the securing body to the housing of the plug.

5 Claims, 9 Drawing Sheets

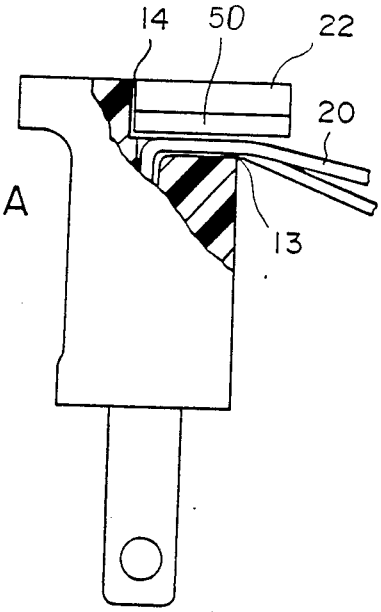
FIG. 4A
FIG. 4B
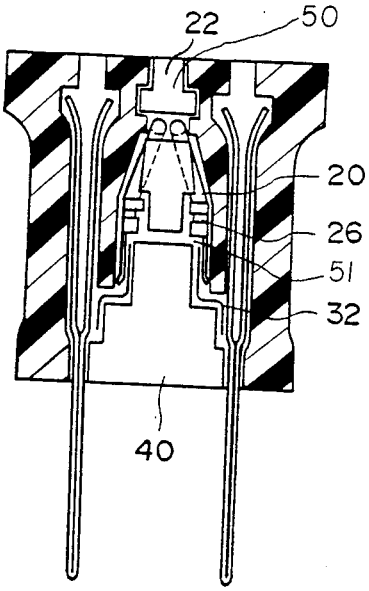
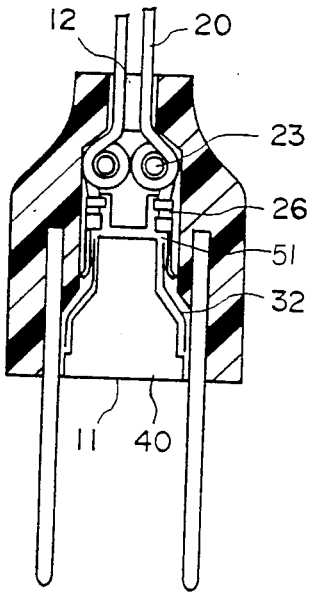
FIG. 3

(A)

(B)

(C)

(D)

(E)

ELECTRICAL PLUG AND SOCKET HAVING REPLACEABLE OVERCURRENT PROTECTION DEVICE WITH SAFETY LATCH MEANS

This is a divisional application of Ser. No. 693,015 that was filed on Jan. 18, 1985, now abandoned.

FIELD AND BACKGROUND OF THE DIVISIONAL APPLICATION

The original application was made up of two main categories of plugs. These two main categories concerned overcurrent protection devices that were either (1) removable from a front end opening or prong end opening of the plug or (2) removable from a rear wall opening of the plug.

For the purpose of orientation, the front end of the plug has a pair of metallic prongs projecting from it while the rear end may have a pair of add on plug slots or sockets which are adapted to receive the prongs of a second plug. The plug consists of four walls including, a top wall, a bottom wall, and two side walls surrounding a through opening.

The term "plug" as referred to in this specification may therefore be a single plug having a pair of prongs in the front along with a pair of receptacle slots at the rear end.

In this divisional application of Ser. No. 693,015, the first category includes original FIGS. 1, 2, 3 and 6, and FIGS. 5, 6, 7, 8, 9, 10, 11, 12, 13, 14, 16, 17 as well as FIGS. 15 and 4, the latter two having also been modified and adopted as embodiments in a CIP application Ser. No. 894,349.

In addition to this divisional application, the remainder of the original drawings of the original application FIGS. 18 , 19, 20, and 21 are included in another divisional application, Ser. No. 942,502.

SUMMARY OF THIS DIVISIONAL APPLICATION

Therefore, the object of the present invention is to provide an electrical plug comprising an insulated housing having an open channel, therein provided with a pair of conductors each having a conductor terminal fixed thereto. An insulated member, either formed integrally with the housing or formed as a separate piece, sits between the terminals, on opposite sides of the channel, in order to fix the terminals to the housing. Between the prongs is situated a removable securing body that holds the prongs in the housing. A pair of fuse members or overcurrent protection devices are also held in the channel by the securing body so that the fuse member's connection between each of the prongs and each of the terminals is maintained.

It is to be understood that in this application and the other applications prior to this, the "plug" always applies to plug and plug/socket varieties and the admission of conductors into the housing may either be from the rear end of the through opening (channel), or from under the bottom wall side.

In the rear-end-admission type, the conductors can be secured in the plug in a variety of ways. The conductors may be of the type that are wound on a post before a terminal is connected to the wire end. The conductor may also be of the type that is squeezed through a clearance between a pair of matched concave-convex members and fastened therein. Or the conductors may be of the type that are secured by being pressed tightly by a latch having a T cross section across the rear end of the plug.

The aforementioned variations actually do not have significant meanings since they are mostly conventional and have already been adopted in the prior arts. After entering into the through opening or channel, no matter whether a separate seat is provided, conductors can always be fastened within the housing.

In the housing of the plug a terminal portion of the conductor connects the conductor to a connecting element of the fuse member or overcurrent protection device. The fuse or overcurrent protection device can be of any known type including a tubular, plate, strap, or filament type. The fuse or overcurrent protection device then also contacts the prong element.

The uniqueness of the present invention lies in a securing body or bodies which hold the fuse or overcurrent protection device in place either by the fuse winding around the securing body (in the case of a filament fuse), hanging on the securing body (in the case of a tubular fuse), or snapping onto the securing body (in the case of a premounted eyeleted plate fuse). The securing body or seat is generally made of a loop member, which may be self closing, like a ring, or opened having legs that are biased by a spring of any type; including spiral, loop, or bend of an inverted V shape, against the inside parts of the legs of the seat. The seat or body having on the outside of each of the legs or of each lower part of the ring, if it is of the self-closing type, a projection to be engaged into a corresponding hole provided on the prong member.

The seat, as provided, can be of single deck or double deck type, the latter type having a second seat situated on top of a first one. The second seat is usually of a spread-leg type, and may also be split into two independent members. A cross shape or antenna shape means or head is provided on top of the first seat to engage with a matched recess disposed within the second seat. The second seat may also be provided with a biasing spring of any known type to enhance its wide opened legs so as to press tightly against the inner wall of the housing. The second seat may also serve as the fuse seat as well as the press wedge of the conductor in lieu of the first seat.

In this divisional application, the securing body or the fuse seat is inserted into the through opening or channel from the front end or prong end of the plug.

Now a detailed description of the invention is to be described in detail through the preferred embodiments accompanied by the annexed drawings.

A BRIEF DESCRIPTION OF THE DRAWINGS

Actually, this divisional application deals essentially with the category having the fuse seat or securing body inserted from the front end, therefore no further notifications shall be made hereinafter in the brief description of the drawings.

Figure 5:
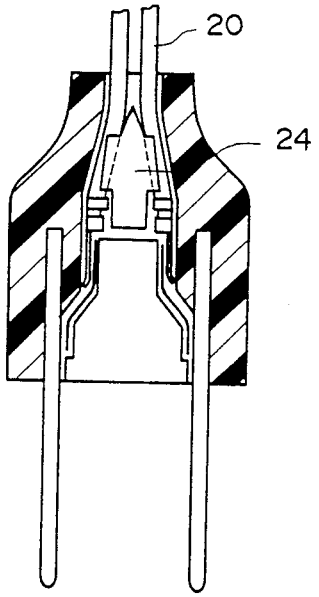
Figure 6:
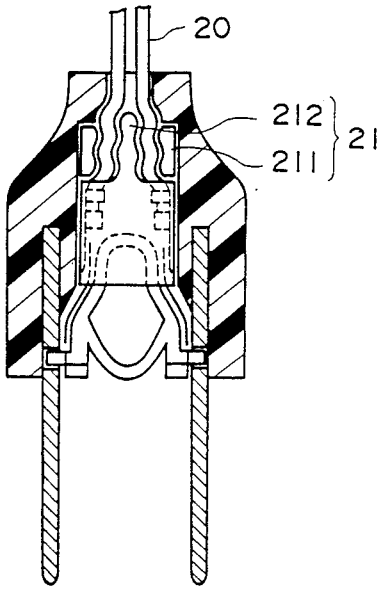
Figure 7:
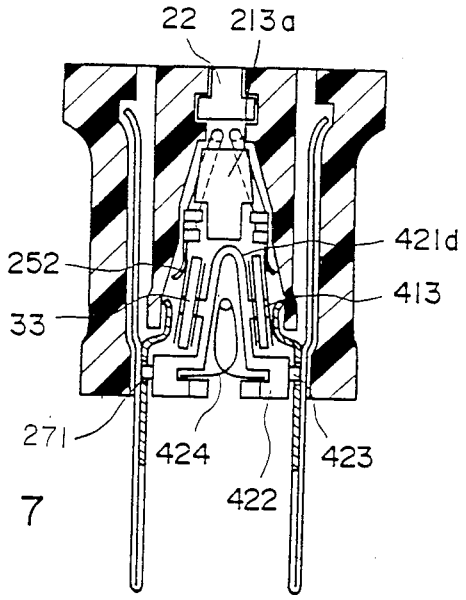
Figure 11:
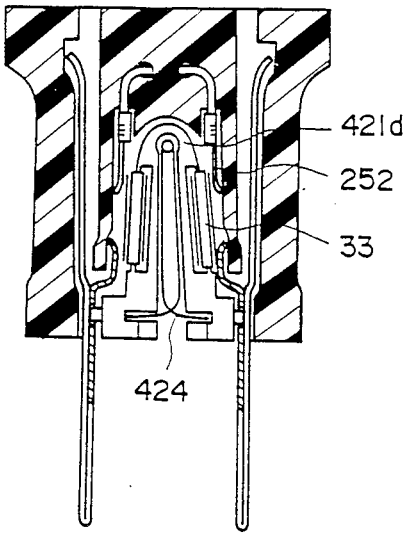

FIG. 3 is a sectional view showing the rear admission of the conductors;

FIGS. 4A and 4B are two sectional views taken respectively from the side and top of a plug/socket showing the bottom admission;

FIG. 5 shows a wedge type fastener for the capture of a pair of rear end admitted conductors of a plug of the present invention;

FIG. 6 shows a concave/convex member type fastener for the capture of a pair of rear end admitted conductor of a plug;

FIG. 7 shows mainly an inverted T shaped latch for the capture of bottom admitted conductors with the aid of a wedge.

Figure 9:
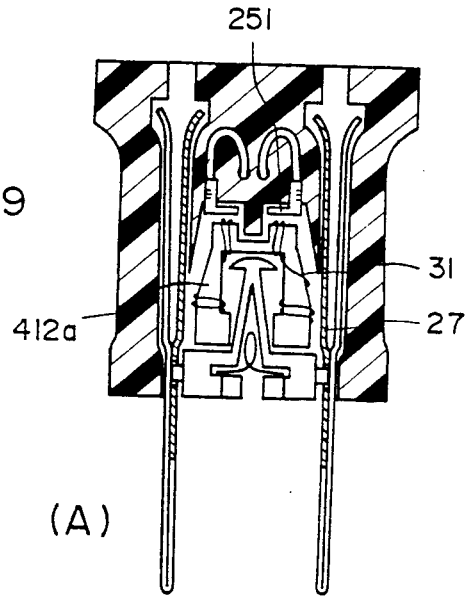
Figure 9:
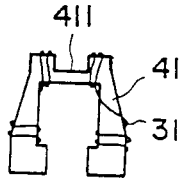
Figure 9:
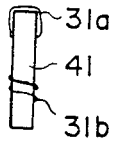
Figure 9:
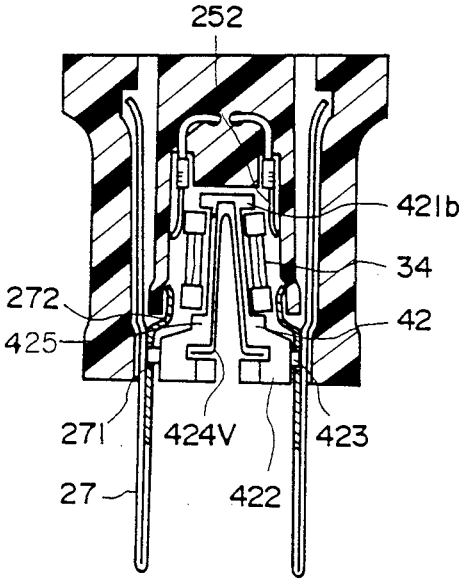
Figure 8:
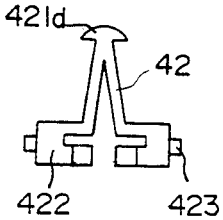
Figure 8:
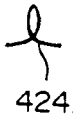
Figure 10:
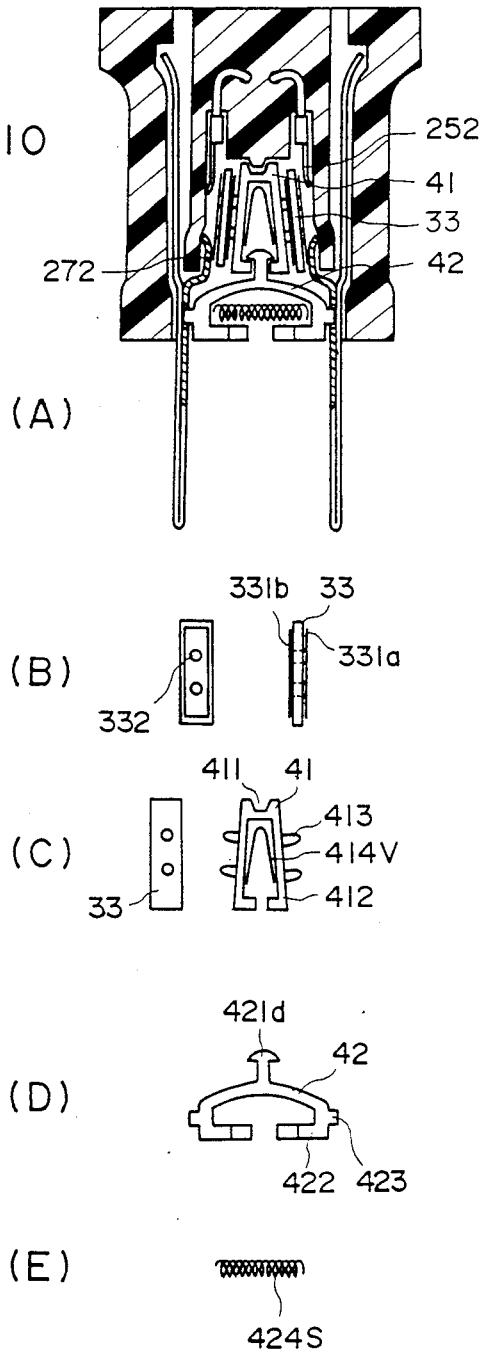
Figure 12:
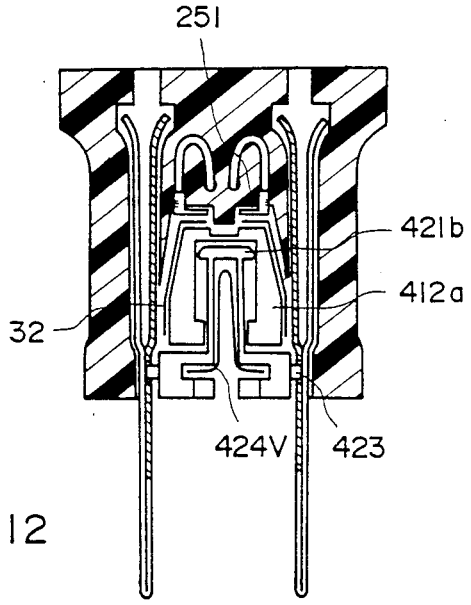
Figure 13:
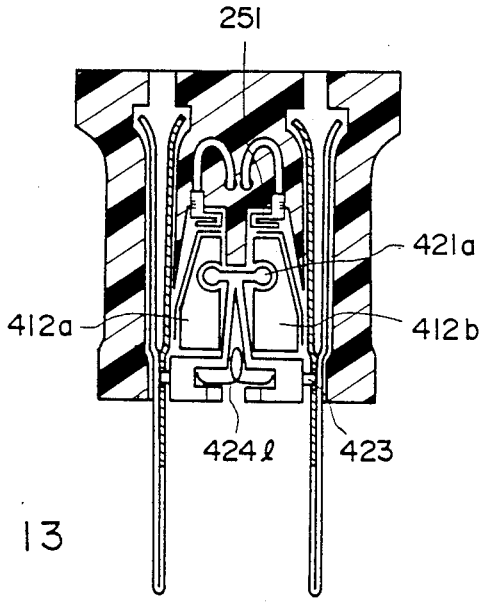
Figure 14:
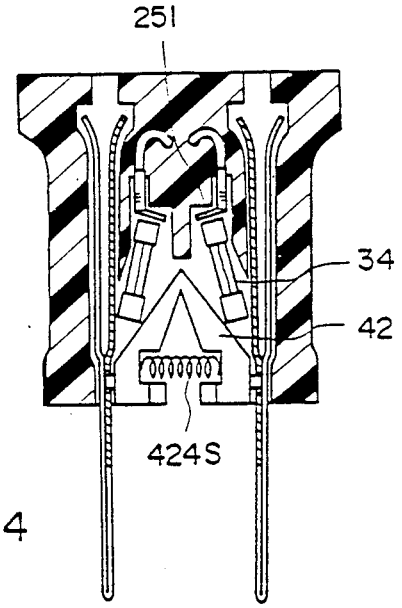
Figure 15:
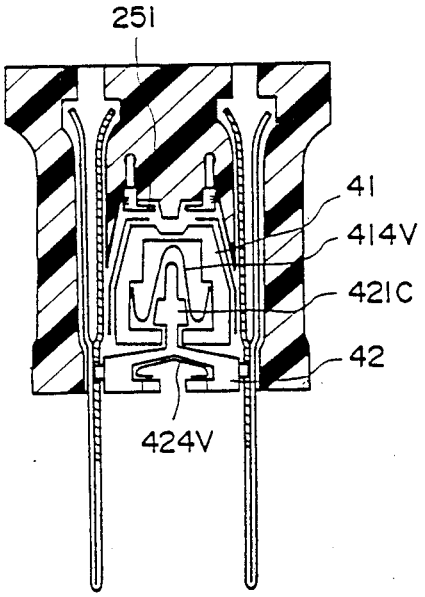
Figure 16:
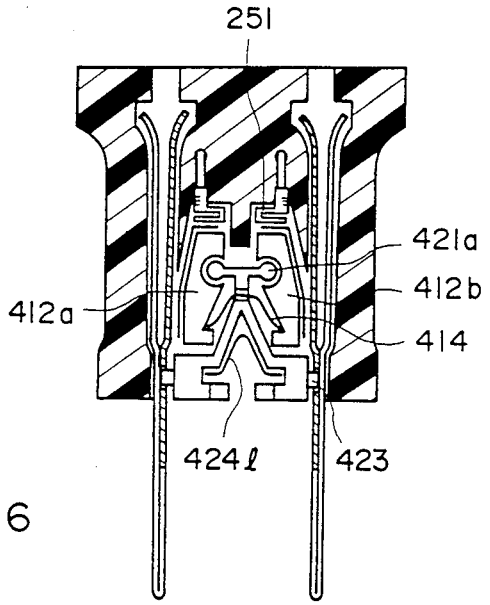
Figure 17:
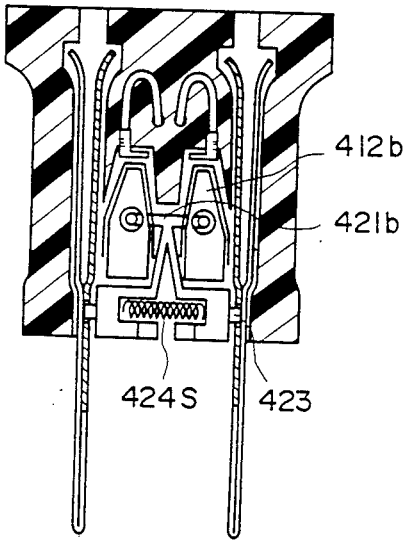

FIG. 8 shows bottom-admitted conductors with outward bent end and single deck fuse seat or securing body with the tubular type of fuse or overcurrent protection device;

FIG. 9 is a sectional view showing a plug/socket with bottom admitted conductors with inward bent ends and a double deck securing body or fuse seat wound with a filament type fuse; also divided to show the respective parts thereof;

FIG. 10 shows a plug/socket having a double deck securing body or fuse seat with the plate type fuse;

FIGS. 11 through 17 are variations of securing body or fuse seat, all are the of front-end-insertion type.

DETAILED DESCRIPTION OF EMBODIMENTS

Figure 1:
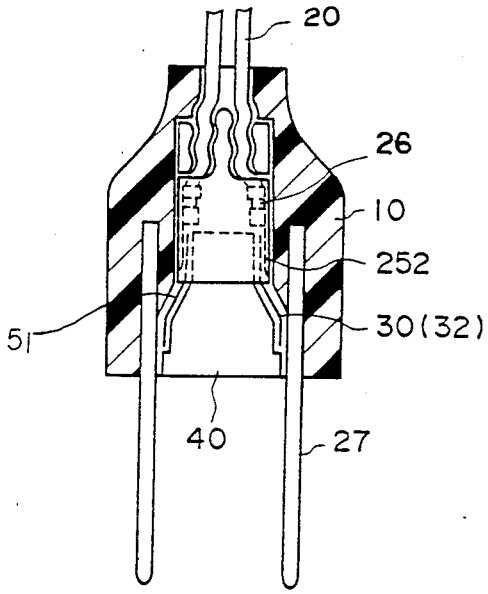
FIG. 1 is a sectional view of a simple plug with the front insertion of the fuse seat or securing body.
Figure 2:
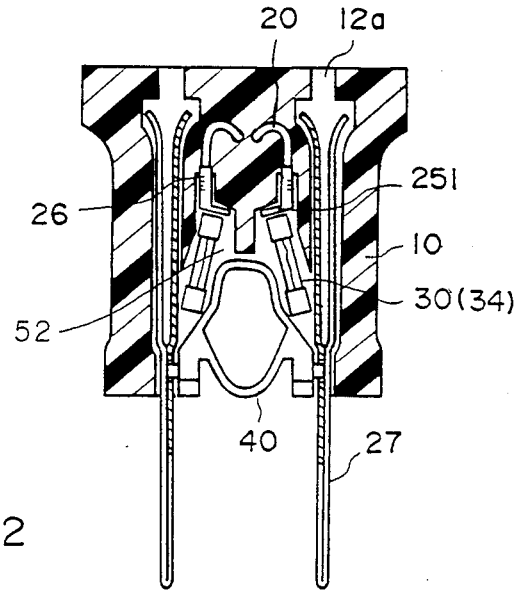
FIG. 2 is a sectional view of a plug/socket also with the front insertion of the fuse seat or securing body.

Now referring to FIGS. 1 and 2, FIG. 1 shows a simple plug while FIG. 2 a plug/socket both having respective housing 10, of insulating material and a pair of metallic prongs 27, projecting from the front end. A pair of conductors 20, admitted into the housing where a through channel 51 (FIG. 1) or recess 52 (FIG. 2) is provided. Each conductor end is connected to a terminal 26, the conductor end may form an inward bend 251 (FIG. 2) or outward bend 252 (FIG. 1). Through a fuse member or overcurrent protection device 30, each terminal 26 is connected to a prong 27, said fuse member 30 may be selected from any known type such as a strap 32 (FIG. 1) or tubular 34 (FIG. 2) which is in turn pressed against a prong 27 by way of a securing body or seat 40. Generally speaking, both the plug of FIG. 1, and plug/socket of FIG. 2 all falling into the category of securing housing body 40, inserted from the prong end, in other words, without pulling the plug out from the power source, it is impossible to remove the securing body from the recess or channel of the plug to expose the conductors and/or terminals so that safety is assured.

FIG. 3 and FIGS. 4A, 4B aim to depict the ways conductors may be admitted into the housing in FIG. 3. The conductors 20, enter the housing through a rear end opening 12 opposite the front end opening 11, and the openings 11–12 form a through channel 51. After entering the housing, each conductor 20 is wound around a prefabricated post 23, before being connected to a terminal 26. In FIGS. 4A and 4B, it can be seen that the conductors 20, enter into the housing through the bottom wall opening 13. In FIG. 4, the conductors 20 enter into the housing through the bottom wall opening 13, a latch 22, of an inverted T shaped section 50 is provided at rear bottom opening 14 of the plug/socket to prevent the conductors 20 from slipping out.

FIGS. 5, 6 and 7 further illustrate the fastening means other than the anchoring post mentioned in FIG. 3, the inverted T shape latch 22 does not necessarily mean a fastening device. In FIG. 5, a wedge 24 inserted between the incoming conductors serves the purpose of fastening. In FIG. 6, the two incoming conductors 20 are backed with concave members 211, and inserted between the conductors 20 a complementary convex member 212 is squeezed in to achieve the fastening purpose. In FIG. 7, other than the inverted T latch 22, a modified wedge 213*a* is provided to serve the fastening purpose.

The securing body heretofore mentioned and indicated by a generalized numeral 40 is of the simplest type, i.e. a self-biased close ring type. In FIG. 7 a more specific type 42 of open legs and biased by a loop spring 424 is provided, outside the leg portion 422, there is a snap projection 423 for snapping into a fixing hole 271 disposed in the prong 27. The details of mounting a fuse onto such type of securing body is to be related later in a more complicated case.

FIGS. 8, 9 and 10 depict three examples of fuse mounting. FIG. 8 shows a relatively simple type of securing body 42 having open legs 422 with a snap projection 423 which is to be snapped into a fixing hole 271 disposed on the prong 27. Said body is of single deck type with a flat head 421*b*, tubular type fuse members 34 are placed around its neck or the portion defined between the head 421*b* and a shoulder 425. By pushing together the legs 422–422, so that the projections 423 would be out of engagement with the hole 271 on prong 27, and the securing body is in turn extractable for the replacement of the fuse 34. The tubular fuse 34 is mounted with one end engaging the outward bent conductor 252 and the other end of the fuse contacting a short leg member 272 of the prong 27.

In FIG. 9, a double-deck securing body is shown which consists of an upper deck 41 and a lower deck 42. The upper deck 41 is of the open-leg type with a sinking neck 411 connecting the respective leg members 422. On each leg there is wound a filament type fuse 31, one end 31*a* of which is to engage the inward bend of an incoming conductor 251 and the other end 31*b* to contact the prong 27. The upper deck 41 is to piggyback on the lower deck 42 which is also of the open leg type having a mushroom head 421*d* and snap projection 423 on each leg 422. The legs are biased by a loop spring 424*l*.

FIG. 10 shows a double decked securing body of which the upper deck 41 is of open leg type having sinking neck 411 connecting the respective leg members 412. Protrusions 413 outside each leg 412 are for mounting a base plate 33 provided with mounting holes 332 thereon and each with plate type fuse 331*a*, 331*b* attached on each side of the base 33. Fuse 331*a* and 331*b* are interchangeable when one of them fails, the other may be replaced by turning the base over. An inverted V type bias spring V 414 is also shown here for the upper deck legs. The lower deck 42 of the securing body is almost of similar configuration as shown in FIG. 9, with only one exception, the bias spring here is of a spiral type 424S instead of the loop type 424*l*.

FIGS. 11 through 17 are further variations yet they are all of the frontal insertion type of securing body and therefore belong to the category as this divisional application. The following tabulation is to facilitate the comparision of the essential factors which are self explanatory and no further description shall be required:

TABLE I

A COMPARISION OF THE MAIN STRUCTURAL FEATURES IN FIGS. 11 THROUGH 17

Supplemental to the following TABLE, some further notes will be required. In the upper decks 41 of the double deck type securing body, wherein the legs 412 may be of an integral or separate type 412*a* or 412*b*, the opening formed by the legs corresponds to the type of head used on the lower deck. In the lower deck 42, the head 421 may be of an antenna type a, flat type b, cross type c and mushroom or round type d.

Only fuses of the strap type 32, plate type 33 and tubular type 34 are seen in the embodiments tabulated. As for the filament type 31, reference is made to FIG. 9.

This application is illustrated and described by way of embodiments, modifications thereof are readily carried out by those skilled in the art without departing from the spirit of the present invention. The scope of the invention shall be covered by the annexed claims.

TABLE I

A COMPARISON OF MAIN STRUCTURAL FEATURES IN EMBODIMENTS (FIGS. 11 THROUGH 17)

| | SECURING BODY (40) | | | | | | |
|---|---|---|---|---|---|---|---|
| | UPPER DECK (41) | | | CONDUCTOR (20) | LOWER DECK (42) | | |
| FIGS. | TYPE | LEG | BIAS SPRING | END BENT | HEAD | BIAS SPRING | FUSE |
| 11 | S | — | — | 252 | 421 d | 424 l | 33 |
| 12 | D | 412 a | — | 251 | 421 b | 424 l | 33 |
| 13 | D | 412 b | — | 251 | 421 a | 424 l | 32 |
| 14 | S | — | — | 251 | — | 424 S | 34 |
| 15 | D | 412 a | 414 V | 251 | 421 C | 424 V | 32 |
| 16 | D | 412 b | 414 V | 251 | 421 a | 424 S | 32 |
| 17 | D | 412 B | — | 251 | 421 a | 424 S | 32 |
| REMARKS | Type of deck<br>D. Double deck<br>S. Single | 412 Leg & Head<br>a. Integral<br>b. Separate | 414 Spring<br>l. loop<br>S. Spiral<br>V. Inverted V | 25 Bent<br>251 Inward<br>252 Outward | 421 Head<br>a. Antenna type<br>c. Cross type<br>b. Flat type<br>d. Mushroom type | 424 Spring<br>l. loop<br>V. Inverted V<br>S. Spiral type | 30 Fuse<br>31 Filament*<br>32 Strap<br>33 Plate<br>34 Tubular |

*Refer: FIG. a

I claim:

1. An electrical plug and socket comprising:

a housing of insulated material having either a front opening or a front and rear opening, the opening or openings forming a recess or through channel in the housing;

a pair of metallic prongs seated in and projecting out from the front of the housing;

a pair of conductors positionable in the housing from one of the rear and bottom of the housing;

an overcurrent protection device with connecting elements, said connecting elements connecting a terminal of each conductor to a terminal of a respective prong, said overcurrent protection device having a safety latch means in the form of a securing body pressing the connecting elements of the overcurrent protecting device against the terminals of the conductors and the prongs, the entire securing body and overcurrent protection device being inserted and removable through the front opening of said housing, wherein the securing body consists of two members including an upper member of an open loop shape seated on top of a lower member.

2. The plug and socket according to claim 1, wherein the upper member of the securing body serves to retain the overcurrent protection device in position by a connecting means between the overcurrent protection device and the securing body.

3. The plug and socket according to claim 1, wherein the lower member of the securing body has means for engaging into a corresponding opening of the upper member for provision of a tight fit for keeping the upper member, the overcurrent protection device, and the prongs in place.

4. The plug and socket according to claim 1, wherein one of said upper and lower members includes means for engaging the prongs to retain one of said members therein.

5. The plug and socket according to claim 1, wherein one of said upper and lower members includes a spring opening and spring means engageable in said spring opening for urging one of said upper and lower securing body members to engage said prongs.

* * * * *